US007552983B2

(12) United States Patent
Shin

(10) Patent No.: US 7,552,983 B2
(45) Date of Patent: Jun. 30, 2009

(54) DOOR BASKET REFRIGERATOR

(75) Inventor: Tae-Su Shin, Daejeon (KR)

(73) Assignee: LG Electronics Inc., Seoul (KR)

( * ) Notice: Subject to any disclaimer, the term of this patent is extended or adjusted under 35 U.S.C. 154(b) by 994 days.

(21) Appl. No.: 10/948,691

(22) Filed: Sep. 24, 2004

(65) Prior Publication Data

US 2005/0073227 A1 Apr. 7, 2005

(30) Foreign Application Priority Data

Oct. 4, 2003 (KR) ..... 10-2003-0069032

(51) Int. Cl.
*A47B 96/04* (2006.01)

(52) U.S. Cl. ..... 312/405.1; 312/321.5; 312/328

(58) Field of Classification Search ..... 312/404, 312/408, 351, 327, 328, 405.1, 321.5; 62/377
See application file for complete search history.

(56) References Cited

U.S. PATENT DOCUMENTS

| | | | | |
|---|---|---|---|---|
| 2,898,173 | A * | 8/1959 | Squire | 312/248 |
| 6,742,855 | B2 * | 6/2004 | Whitaker et al. | 312/405.1 |
| 6,799,818 | B2 * | 10/2004 | Ahmed et al. | 312/405.1 |
| 6,908,163 | B1 * | 6/2005 | Hebeler et al. | 312/405.1 |
| 7,111,914 | B2 * | 9/2006 | Avendano | 312/405.1 |
| 7,469,980 | B2 * | 12/2008 | Koo | 312/405.1 |
| 2003/0020386 | A1 * | 1/2003 | Leimkuehler et al. | 312/405.1 |
| 2003/0080661 | A1 | 5/2003 | Ahmed et al. | |
| 2004/0108799 | A1 * | 6/2004 | Leimkuehler et al. | 312/405.1 |
| 2004/0178711 | A1 * | 9/2004 | Avendano | 312/405.1 |
| 2006/0250063 | A1 * | 11/2006 | Czach et al. | 312/405.1 |

* cited by examiner

*Primary Examiner*—Janet M Wilkens
(74) *Attorney, Agent, or Firm*—Ked & Associates LLP

(57) ABSTRACT

A door basket for a refrigerator is provided that includes a fixed casing portion and a pivotable accommodation portion. The fixed casing portion includes a predetermined seating space opened upward and forward and is formed to extend from side to side and be fixed horizontally to a door liner. The pivotable accommodation portion includes a predetermined accommodation space opened upward is pivotably installed to the fixed casing portion, and is formed to extend from side to side. A lower surface of the pivotable accommodation portion is supported on a bottom surface of the fixed casing portion in a state in which food is accommodated in the accommodation space. Both the fixing casing portion and the pivotable accommodation portion may be formed by injection molding. With such structure, the door basket for a refrigerator may be manufactured at reduced cost, prevent accommodated foods from hindering pivoting thereof, be easily manufactured and installed, and be freely adjusted in installation height.

6 Claims, 5 Drawing Sheets

DOOR BASKET REFRIGERATOR

BACKGROUND OF THE INVENTION

1. Field of Invention

The present invention relates to a refrigerator, and more particularly, to a door basket for a refrigerator which is installed on a rear surface of a door to store foods therein.

2. Description of the Prior Art

FIGS. 1 and 2 show a door basket for a refrigerator according to a prior art.

As shown in the figures, a pair of projections 14 are formed along the vertical direction at both sides of a door liner 12 which defines a rear surface of a door 10 for the refrigerator. A plurality of supporting shelves 16, 17, and 18 are formed to extend from side to side between the projections 14 and provided at predetermined intervals. At least a pair of holders 22 are installed on inner side surfaces of the projections 14, respectively. The holders 22 for installing a door basket 30, which will be described bellow, are installed so that lower surfaces thereof are supported on upper surfaces of the supporting shelves 17 and 18. Lower edges of inner side surfaces of the holders 22 are formed with hinge holes 24 flush with each other, respectively.

The respective door baskets 30 are installed between the inner side surfaces of the holders 22. The door basket 30 for accommodating foods, which is formed substantially in a hexahedron extending from side to side, is provided with an accommodation space 32 which is formed by arranging a plurality of wires with a certain diameter at predetermined intervals and the upper surface of which is opened.

In the meantime, both side surfaces of a lower end of the door basket 30 are formed with hinge projections 34 which are inserted into the hinge holes 24, respectively. Thus, with the hinge projections 34 being inserted into the hinge holes 24, the door basket 30 is installed so that a lower surface thereof is supported on the upper surface of the supporting shelf 18.

In the accommodation space 32 of the door basket 30 so constructed, a variety of foods are accommodated. With the foods being accommodated in the accommodation space 32, the lower surface of the door basket 30 is supported on the upper surface of the supporting shelf 18. When the foods are taken in and out of the door basket 30, if the door basket 30 pivots forward (i.e., counterclockwise in FIG. 2) about the hinge projections 34 inserted into the hinge holes 24, it is easy to take the foods in and out of the door basket.

However, the door basket of the refrigerator according to the prior art as described above has the following problems.

As described above, since the door basket 30 is formed by knitting the plurality of the wires, the above door basket 30 is manufactured with increased cost as compared with ones manufactured by other methods such as injection molding.

In addition, since the door basket 30 consists of the plurality of the wires, the accommodation space 32 communicates with the outside through gaps between the wires. Therefore, the foods or parts thereof accommodated in the accommodation space 32 are projected through such gaps and bump against a portion of the holders 22 in a pivoting process of the door basket 30, which may hinder the door basket 30 from pivoting.

Further, in order to install the door basket 30, the door basket 30 should be installed between the holders 22 after fixing the holders 22 to the projections 14 of the door liner 12. That is, since the door basket 30 should be installed to the holders 22 in a narrow space between the inner side surfaces of the projections 14, it is not easy to assemble the door basket 30 to the door liner 12.

Furthermore, since the door basket 30 is installed to the projections 14, i.e., the holders 22 fixed to the projections 14 of both the sides of the door liner 12, it is not easy to adjust a height of the door basket 30.

SUMMARY OF THE INVENTION

Accordingly, the present invention is conceived to solve the aforementioned problems in the prior art. An object of the present invention is to provide a door basket for a refrigerator of which manufacturing costs can be reduced.

Another object of the present invention is to provide a door basket for a refrigerator of which pivoting action cannot be hindered by stored foods.

A further object of the present invention is to provide a door basket for a refrigerator which can be easily installed.

A still further object of the present invention is to provide a door basket for a refrigerator of which the height can be freely adjusted.

According to the present invention for achieving the objects, there is provided a door basket of a refrigerator, comprising a fixed casing portion including a predetermined seating space opened upward and forward, the fixed casing portion being formed to extend from side to side and fixed horizontally to a door liner; and a pivotable accommodation portion pivotably installed to the fixed casing portion, the pivotable accommodation portion including a predetermined accommodation space opened upward and being formed to extend from side to side, wherein a lower surface of the pivotable accommodation portion is supported on a bottom surface of the fixed casing portion in the state that foods are accommodated in the accommodation space.

The fixed casing portion is fixed to the door liner by means of a plurality of fastening projections and fastening grooves, the fastening projections and the fastening grooves being formed at positions corresponding to each other on both sides of the door liner and both side surfaces of the fixed casing portion, respectively.

Preferably, the plurality of the fastening projections are provided at opposite positions on both the sides of the door liner at regular vertical intervals.

More preferably, hinge projections and hinge holes into which the hinge projections are inserted are provided at positions corresponding to each other of lower edges of both side surfaces of the fixed casing portion and lower edges of both side surfaces of the pivotable accommodation portion, respectively, so that the pivotable accommodation portion is pivotably installed into the fixed casing portion.

Still more preferably, catching projections which allow the pivotable accommodation portion to pivot with respect to the fixed casing portion within a predetermined range and stoppers onto which the catching projections are caught are provided at positions corresponding to each other of on both the side surfaces of the fixed casing portion and both the side surfaces of the pivotable accommodation portion, respectively.

Still more preferably, the catching projections are provided at front ends of pivoting guides, which are formed in upper ends of both the side surfaces of the fixed casing portion and guide pivoting action of the pivotable accommodation portion, respectively; the stoppers are provided in lower surfaces of flanges protruding outward from upper ends of both the side surfaces of the pivotable accommodation portion, respectively.

The fixed casing portion and the pivotable accommodation portion are formed by injection molding.

According to the present invention, there are advantages in that the door basket for the refrigerator can be manufactured with reduced cost, prevent the stored foods from hindering the pivoting action thereof, be easily installed, and be freely adjusted in its installation height.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of the present invention will be described in detail with reference to the accompanying drawings.

Figure 1:
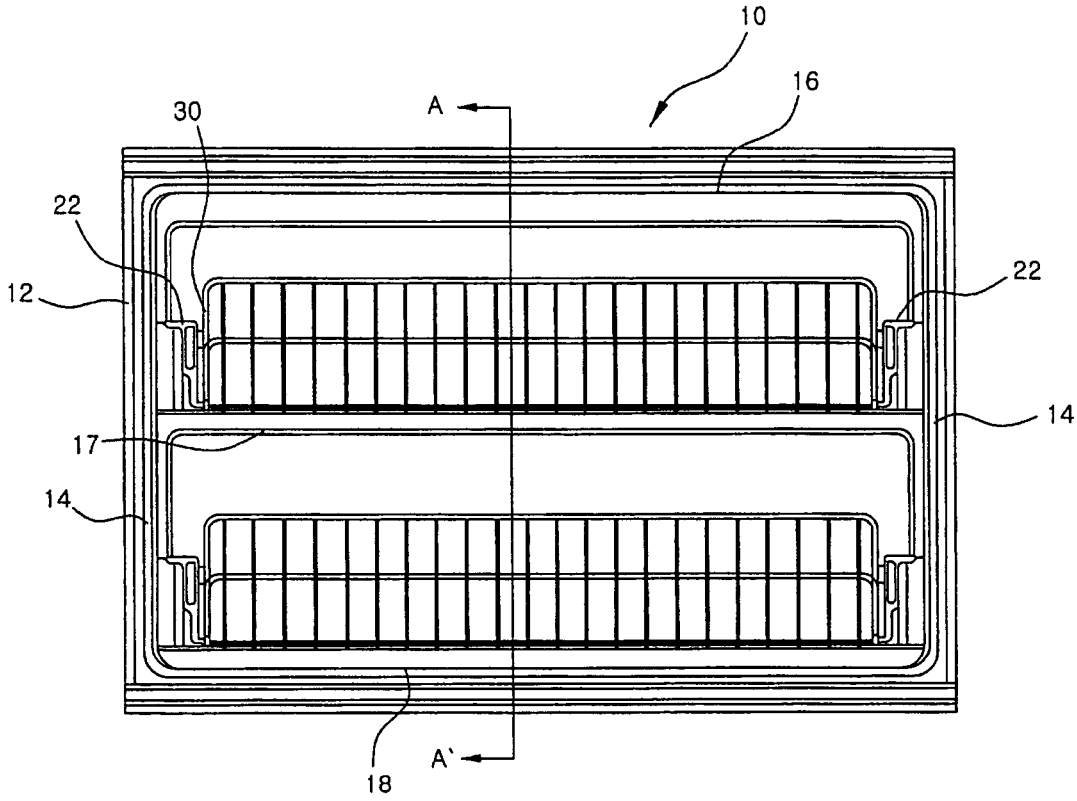
FIG. 1 Related Art
FIG. 1 is a rear elevational view of a door on which a door basket for a refrigerator according to a prior art is installed.
Figure 2:
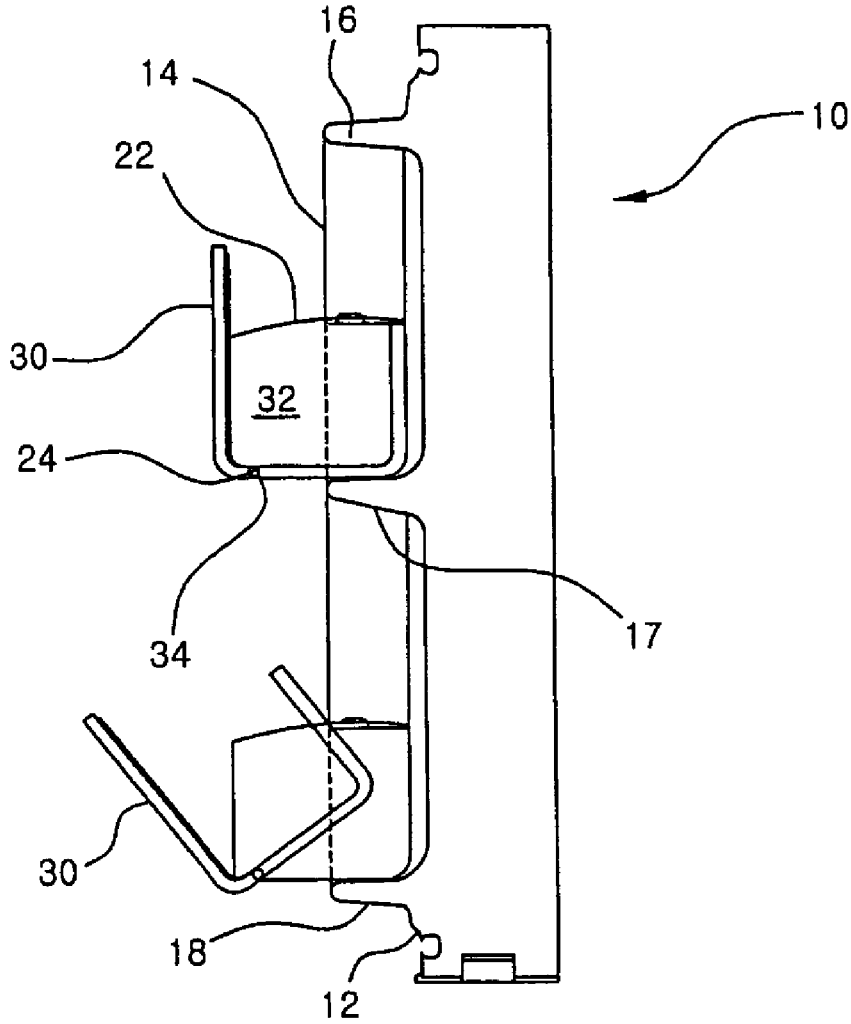
FIG. 2 Related Art
FIG. 2 is a sectional view of the door taken along line A-A' of FIG. 1.
Figure 3:
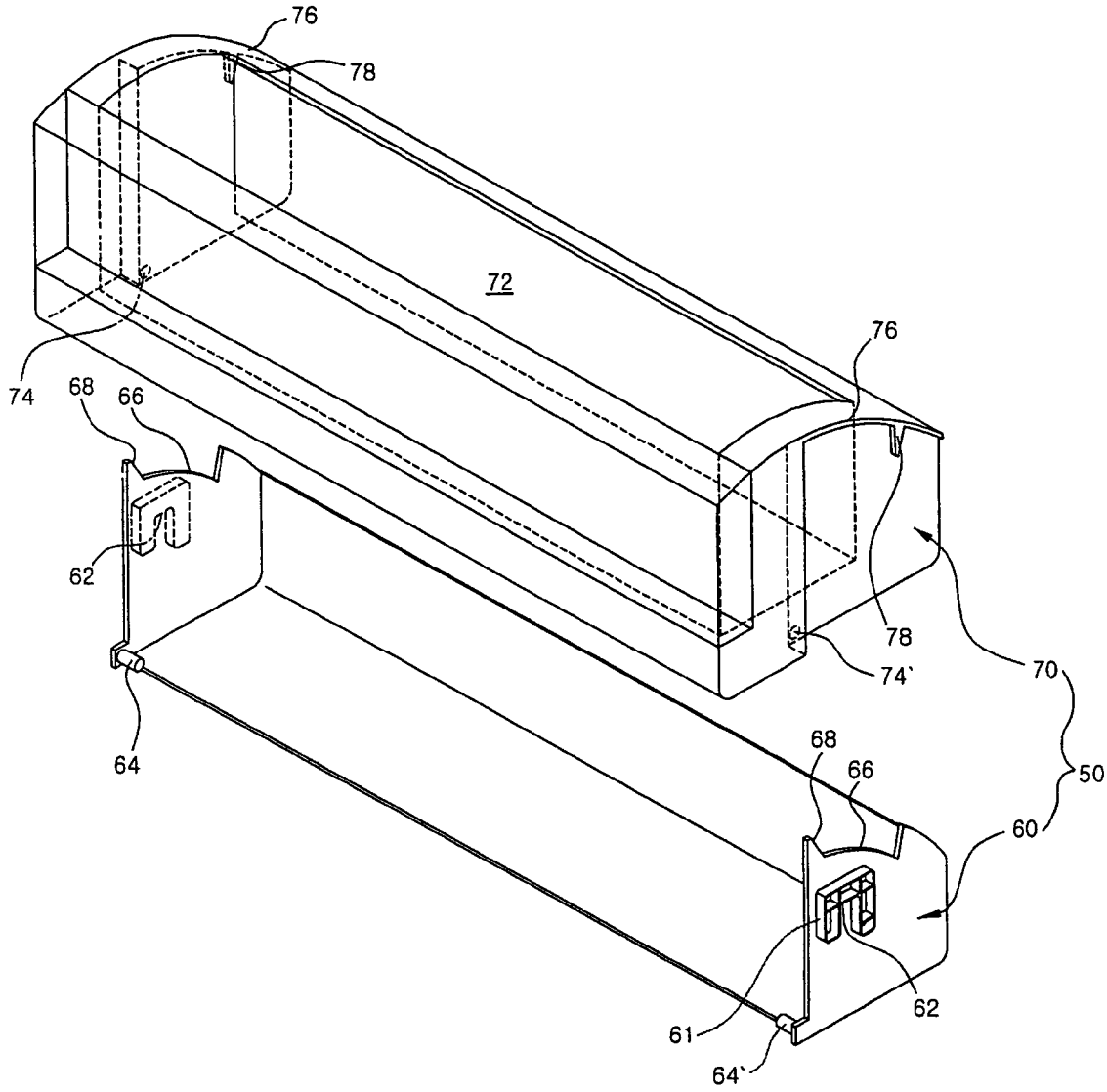
FIG. 3 is an exploded view of a preferred embodiment of a door basket for a refrigerator according to the present invention.
Figure 4:
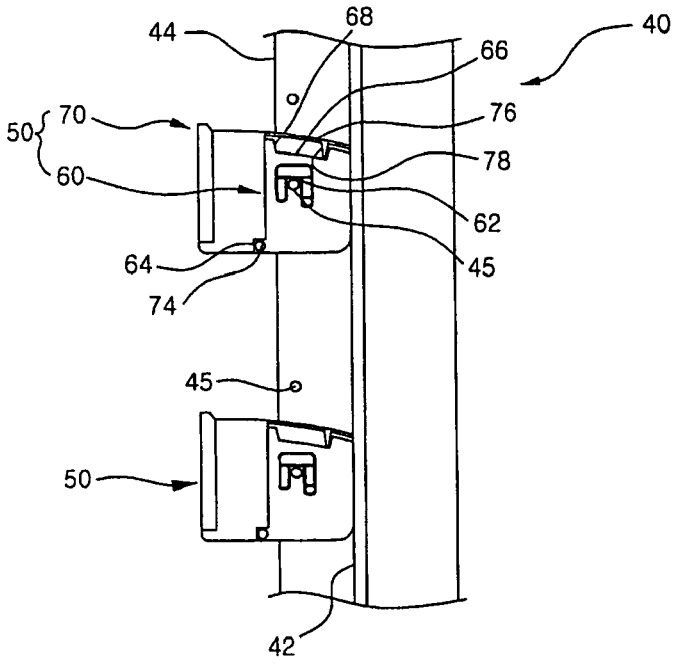
FIG. 4 is a sectional side view of a door for the refrigerator on which the embodiment of FIG. 3 is installed.

FIG. 3 is an exploded view of a preferred embodiment of a door basket for a refrigerator according to the present invention. FIG. 4 is a sectional side view of a door for the refrigerator on which the embodiment of the present invention is installed.

As shown in the figures, a rear surface of a door 40 for the refrigerator is mounted with a plurality of door baskets 50. Each door basket 50 comprises a fixed casing portion 60 fixed to a door liner 42 of the door 40 and a pivotable accommodation portion 70 pivotably installed in the fixed casing portion 60. In addition, it is preferred that the fixed casing portion 60 and the pivotable accommodation portion 70 be formed by injection molding.

The fixed casing portion 60, which is formed substantially in a hexahedron extending from side to side, is opened to its upper and front faces. Both side surfaces of the fixed casing portion 60 are formed with projection bosses 61, respectively. Fastening grooves 62 are formed by the projection bosses 61. The fastening grooves 62 for fixing the fixed casing portion 60 to the door liner 42, are formed on both the side surfaces of the fixed casing portion 60 to be opened outward and downward, respectively.

Fastening projections 45 formed on both inner side surfaces of projections 44 of the door liner 42 are inserted into the fastening grooves 62, so that the fixed casing portion 60 is caught onto the projections 44 formed on both sides of the door liner 42.

In the illustrated embodiment, a plurality of the fastening projections 45 are provided at opposite positions on both the projections 44 at regular vertical intervals. Therefore, by selecting the fastening projections 45 to be inserted into the fastening grooves 62, the height where the door basket 50 is installed may be adjusted.

Hinge projections 64 are provided so as to face each other on both inner side surfaces of the fixed casing portion 60, which are opposite to both the side surfaces where the projection bosses 61 are formed, respectively. The hinge projections 64 are formed at both the side surfaces of a front and lower portion of the fixed casing portion 60. The hinge projections 64 are portions about which the pivotable accommodation portion 70 pivots. The hinge projections 64 are inserted into hinge holes 74, which will be described bellow.

In addition, pivoting guides 66 are formed over predetermined sections of upper ends of both the side surfaces of the fixed casing portion 60. An end of each pivoting guide 66 is provided with a catching projection 68. The pivoting guides 66 for guiding the pivoting action of the pivotable accommodation portion 70 are formed by cutting off portions having predetermined width and length from the upper ends of both the side surfaces of the fixed casing portion 60. The catching projections 68 protrude upward from the front ends of the pivoting guides 66, and restrict the pivotable accommodation portion 70 to pivot only within a predetermined angular range.

A predetermined accommodation space 72 opened upward is provided in the pivotable accommodation portion 70, which is shaped substantially in a hexahedron extending from side to side. Both outer side surfaces of the pivotable accommodation portion 70 are formed with the hinge holes 74, respectively. The hinge projections 64 are inserted into the hinge holes 74, so that the pivotable accommodation portion 70 pivots with respect to the fixed casing portion 60.

Upper ends of both the side surfaces of the pivotable accommodation portion 70 are formed with flanges 76 which protrude outward. Lower surfaces of the flanges 76 are provided with stoppers 78. The stoppers 78 serve to guide the pivoting action of the pivotable accommodation portion 70 and to prevent the pivotable accommodation portion 70 from pivoting in excess of a predetermined angular range with respect to the fixed casing portion 60. That is, the stoppers 78, which protrude downward from front ends of the lower surfaces of the flanges 76, move back and forth along the pivoting guides 66 when the pivotable accommodation portion 70 pivots, and are caught onto the catching projections 68 in the state after the pivotable accommodation portion 70 pivots by the predetermined angle.

Hereinafter, the operation of the door basket for the refrigerator according to the present invention with the configuration as described above will be described in detail.

First, installation of the door basket of the present invention to the door will be described. The fixed casing portion 60 formed by injection molding is fixed between the projections 44 provided on both the sides of the door liner 42 of the door 40. Then, the pivotable accommodation portion 70 which is also formed by injection molding is mounted pivotably back and forth to the fixed casing portion 60.

That is, the hinge projections 64 of the fixed casing portion 60 are inserted into the hinge holes 74 of the pivotable accommodation portion 70, respectively. In addition, the stoppers 78 of the pivotable accommodation portion 70 are positioned on the pivoting guides 66 of the fixed casing portion 60. In the state that the pivotable accommodation portion 70 is mounted to the fixed casing portion 60 as described above, the door basket 50 is mounted to the door 40.

Therefore, the door basket 50 is mounted by catching the fastening grooves 62 of the fixed casing portion 60 onto both the fastening projections 45 with a desired height, which are selected out of the plurality of the fastening projections 45 provided on the projections 44 of the door liner 42. Here, since the fastening grooves 62 are opened downward, the fastening projections 45 can be inserted into the fastening grooves 62 by pushing the door basket 50 downward from an upper portion of the door liner 42.

If the door basket 50 is installed to the fastening projections 45 properly selected as described above, height differences between the door baskets 50 installed on the rear surface of the door 40 may be set up as desired. Accordingly, it is possible to properly accommodate tall foods, for example, contained in drinking water bottles.

In addition, as described above, since the fixed casing portion 60 and the pivotable accommodation portion 70 are formed by the injection molding, it is possible to reduce manufacturing cost of the door basket 50. Furthermore, since in the state that the pivotable accommodation portion 70 is installed in the fixed casing portion 60, the fixed casing portion 60 is fixed to the door liner 42 only by pushing the fixed casing portion 60 thereinto, causing the installation to be easy.

Next, referring to FIGS. 5*a* and 5*b*, the operation of the door basket 50 of the present invention will be described.

Figure 5A:
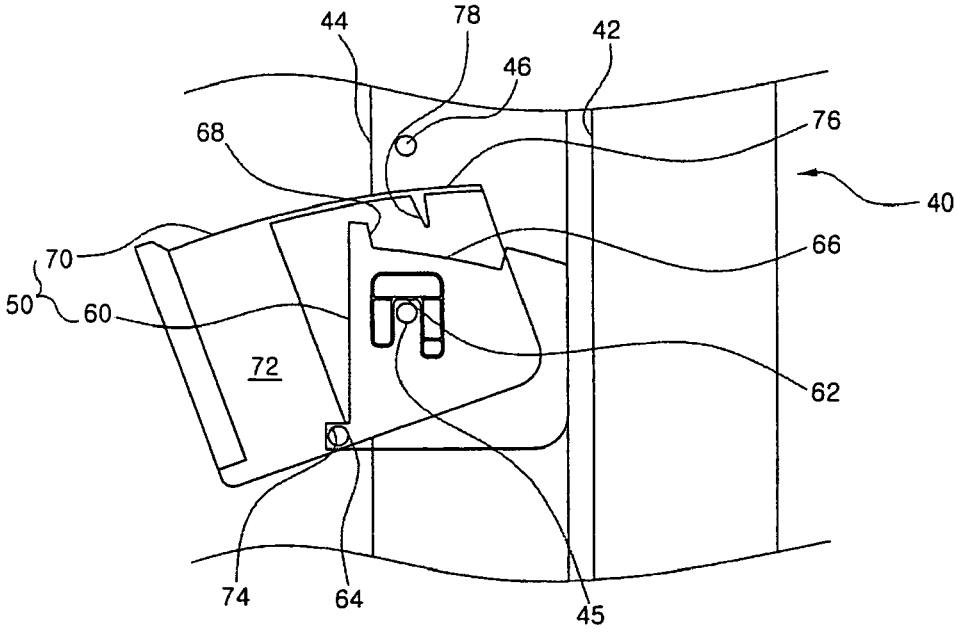
FIGS. 5*a* and 5*b* are views showing the operation of the embodiment shown in FIG. 3.

FIG. 5*a* shows the state that foods are taken in and out of the accommodation space in the door basket. That is, in order to take the foods in and out of the door basket 50, the pivotable accommodation portion 70 pivots with respect to the fixed casing portion 60 by a predetermined angle. Here, the pivotable accommodation portion 70 pivots about the hinge holes 74, into which the hinge projections 64 are inserted, counterclockwise in the figure.

In the meantime, while moving from right to left in the figure along the pivoting guides 66 of the fixed casing portion 60, the stoppers 78 of the pivotable accommodation portion 70 guide the pivoting action of the pivotable accommodation portion 70. In addition, if the pivotable accommodation portion 70 pivots from its initial position counterclockwise with respect to the fixed casing portion 60 within the predetermined angular range, front surfaces of the stoppers 78 are caught onto rear surfaces of the catching projections 68 of the front ends of the pivoting guides 66, and thus, the pivotable accommodation portion 70 pivots no more.

If the pivotable accommodation portion 70 pivots and then is inclined at the predetermined angle as described above, it is easy to accommodate the foods, for example, contained in drinking water bottles into the accommodation space 72 in the pivotable accommodation portion 70, or to take the foods accommodated in the accommodation space 72 out thereof. In addition, since the foods accommodated in the pivotable accommodation portion 70 are not projected to the outside, it is possible to prevent the pivoting action of the pivotable accommodation portion 70 from being hindered by the projection of such foods.

Figure 5B:
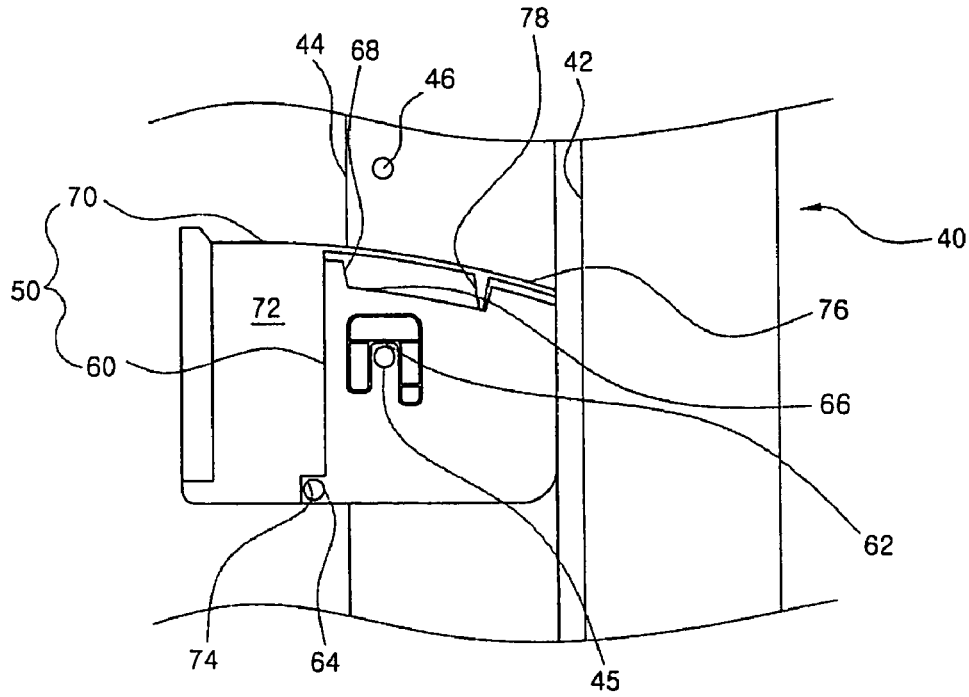

In addition, FIG. 5*b* shows the state that the foods are accommodated in the accommodation space of the pivotable accommodation portion. That is, if the foods are accommodated in the accommodation space 72, the pivotable accommodation portion 70 is made pivot clockwise in the figure. The pivotable accommodation portion 70 pivots about the hinge projections 64 and the hinge holes 74, and the stoppers 78 move from left to right in the figure along the pivoting guides 66.

Then, if the pivotable accommodation portion 70 pivots and reaches its initial position, the stoppers 78 are positioned on rear ends of the pivoting guides 66. In addition, since a lower surface of the pivotable accommodation portion 70 is supported on a bottom surface of the fixed casing portion 60 and a rear surface of the pivotable accommodation portion 70 is in close contact with a rear surface of the fixed casing portion 60, the pivotable accommodation portion 70 pivots no more.

As described above, since the door basket of the refrigerator according to the present invention comprises the fixed casing portion and the pivotable accommodation portion which are formed by the injection molding, the manufacturing cost thereof can be reduced.

In addition, it is possible to prevent the pivoting action of the pivotable accommodation portion from being hindered by the projection of the foods or parts thereof accommodated in the pivotable accommodation portion.

Further, in the state that the pivotable accommodation portion is installed in the fixed casing portion, since the fixed casing portion is fixed to the door liner by pushing the fixed casing portion downward from the upper portion of the door liner, it is easy to install the door basket.

Furthermore, by forming the plurality of the fastening projections for fixing the fixed casing portion on both the sides of the door liner to correspond to each other at predetermined intervals, the height of the door basket can be easily adjusted. Thus, it is possible to effectively use the accommodation space of the pivotable accommodation portion.

The scope of the present invention is not limited to the embodiment described and illustrated above but is defined by the appended claims. It will be apparent that those skilled in the art can make various modifications and changes thereto within the scope of the technical spirit of the invention. Therefore, the true scope of the present invention should be defined by the appended claims.

Although in the illustrated embodiment, the hinge projections and the hinge holes are formed on both the side surfaces of the fixed casing portion and both the side surfaces of the pivotable accommodation portion, the hinge projections and the hinge holes may be formed on both the side surfaces of the pivotable accommodation portion and both the side surfaces of the fixed casing portion, respectively.

In addition, although in the illustrated embodiment, the fastening projections provided on both the inner side surfaces of projections of the door liner are inserted into the fastening grooves formed on both the side surfaces of the fixed casing portion, it is worth consideration that the fastening projections are provided on both the side surfaces of the fixed casing portion and the fastening grooves are formed on both the inner side surfaces of projections of the door liner.

In the meantime, since the flanges provided in the pivotable accommodation portion are for forming the stoppers, it is possible to form the stoppers to protrude outward from both the side surfaces of the pivotable accommodation portion.

What is claimed is:

1. A door basket of a refrigerator, comprising:

a fixed casing portion comprising a predetermined seating space opened upward and forward, the fixed casing portion extending from side to side and fixed horizontally to a door liner;

a pivotable accommodation portion pivotably attached to the fixed casing portion, the pivotable accommodation portion including a predetermined accommodation space opened upward and extending from side to side; and catching projections provided at front ends of pivoting guides formed in upper ends of side surfaces of the fixed casing portion and guiding pivoting action of the pivotable accommodation portion; and stoppers, corresponding to the catching projections, provided in lower surfaces of flanges protruding outward from upper ends of side surfaces of the pivotable accommodation portion, wherein a lower surface of the pivotable accommodation portion is supported on a bottom surface of the fixed casing portion in a state in which food is accommodated in the accommodation space.

2. The door basket as claimed in claim 1, wherein the fixed casing portion is fixed to the door liner by a plurality of fastening projections and fastening grooves, the fastening projections and the fastening grooves being formed at positions corresponding to each other on both sides of the door liner and both of the side surfaces of the fixed casing portion, respectively.

3. The door basket as claimed in claim 2, wherein the plurality of the fastening projections are provided at opposite positions on both of the sides of the door liner at regular vertical intervals.

4. The door basket as claimed in claim 1, further comprising hinge projections and hinge holes provided at positions corresponding to each other at lower edges of both of the side surfaces of the fixed casing portion and lower edges of both of the side surfaces of the pivotable accommodation portion, respectively, so that the pivotable accommodation portion is pivotably attached to the fixed casing portion.

5. The door basket as claimed in claim 4, wherein the catching projections and the stoppers, onto which the catching projections are caught, allow the pivotable accommodation portion to pivot with respect to the fixed casing portion within a predetermined range.

6. The door basket as claimed in claim 1, wherein the fixed casing portion and the pivotable accommodation portion are formed by injection molding.

* * * * *